US005136753A

United States Patent [19]

Temburg

[11] Patent Number: 5,136,753

[45] Date of Patent: Aug. 11, 1992

[54] FIBER BALE OPENER HAVING SEPARATELY ADJUSTABLE OPENING ROLL PENETRATIONS

[75] Inventor: Josef Temburg, Jüchen, Fed. Rep. of Germany

[73] Assignee: Trützschler GmbH & Co. KG, Mönchengladbach, Fed. Rep. of Germany

[21] Appl. No.: 746,659

[22] Filed: Aug. 16, 1991

Related U.S. Application Data

[63] Continuation-in-part of Ser. No. 387,992, Aug. 1, 1989, Pat. No. 5,090,091.

[30] Foreign Application Priority Data

Aug. 2, 1988 [DE] Fed. Rep. of Germany ..... 3826201
Apr. 27, 1989 [DE] Fed. Rep. of Germany ..... 3913929

[51] Int. Cl.[5] ..... D01G 7/04; D01G 7/12
[52] U.S. Cl. ..... 19/80 R; 19/97
[58] Field of Search ..... 19/97, 80 R, 81, 145.5, 19/200, 205

[56] References Cited

U.S. PATENT DOCUMENTS

| | | | |
|---|---|---|---|
| 3,135,022 | 6/1964 | Binder | 19/80 R |
| 3,170,196 | 2/1965 | Denis | 19/80 R |
| 4,623,099 | 11/1986 | Vosbein et al. | 19/80 R X |
| 4,750,240 | 6/1988 | Temburg | 19/80 R |
| 4,780,933 | 11/1988 | Pinto et al. | 19/80 R |
| 4,827,572 | 5/1989 | Walk | 19/81 X |
| 4,928,354 | 5/1990 | Hanselmann et al. | 19/80 R X |
| 4,995,142 | 2/1991 | Binder et al. | 19/80 R |

FOREIGN PATENT DOCUMENTS

| | | | |
|---|---|---|---|
| 0394856 | 10/1990 | European Pat. Off. | 19/80 R |
| 0946333 | 1/1964 | United Kingdom | 19/80 R |
| 2222606 | 3/1990 | United Kingdom | 19/80 R |
| 2236121 | 3/1991 | United Kingdom | 19/80 R |
| 2237823 | 5/1991 | United Kingdom | 19/80 R |

*Primary Examiner*—Werner H. Schroeder
*Assistant Examiner*—Ismael Izaguirre
*Attorney, Agent, or Firm*—Spencer, Frank & Schneider

[57] ABSTRACT

A travelling fiber tuft detaching device for removing fiber tufts from top surfaces of stationarily supported fiber bales includes a housing; first and second toothed, parallel detaching rolls accommodated in the housing; first and second pivot frames carrying the first and second detaching rolls, respectively; a pivot shaft for pivotally securing the first and second pivot frames to the housing to provide for a pivotal motion of each pivot frame in a substantially vertical plane relative to the housing; and first and second setting devices articulated to the first and second pivot frames, respecitvely, and to the housing for exerting separately settable adjusting forces to the first and second pivot frames, whereby a height level of the detaching rolls relative to one another is set for effecting penetration of the detaching rolls into a top bale surface to different depths thereof during the detaching operation.

4 Claims, 1 Drawing Sheet

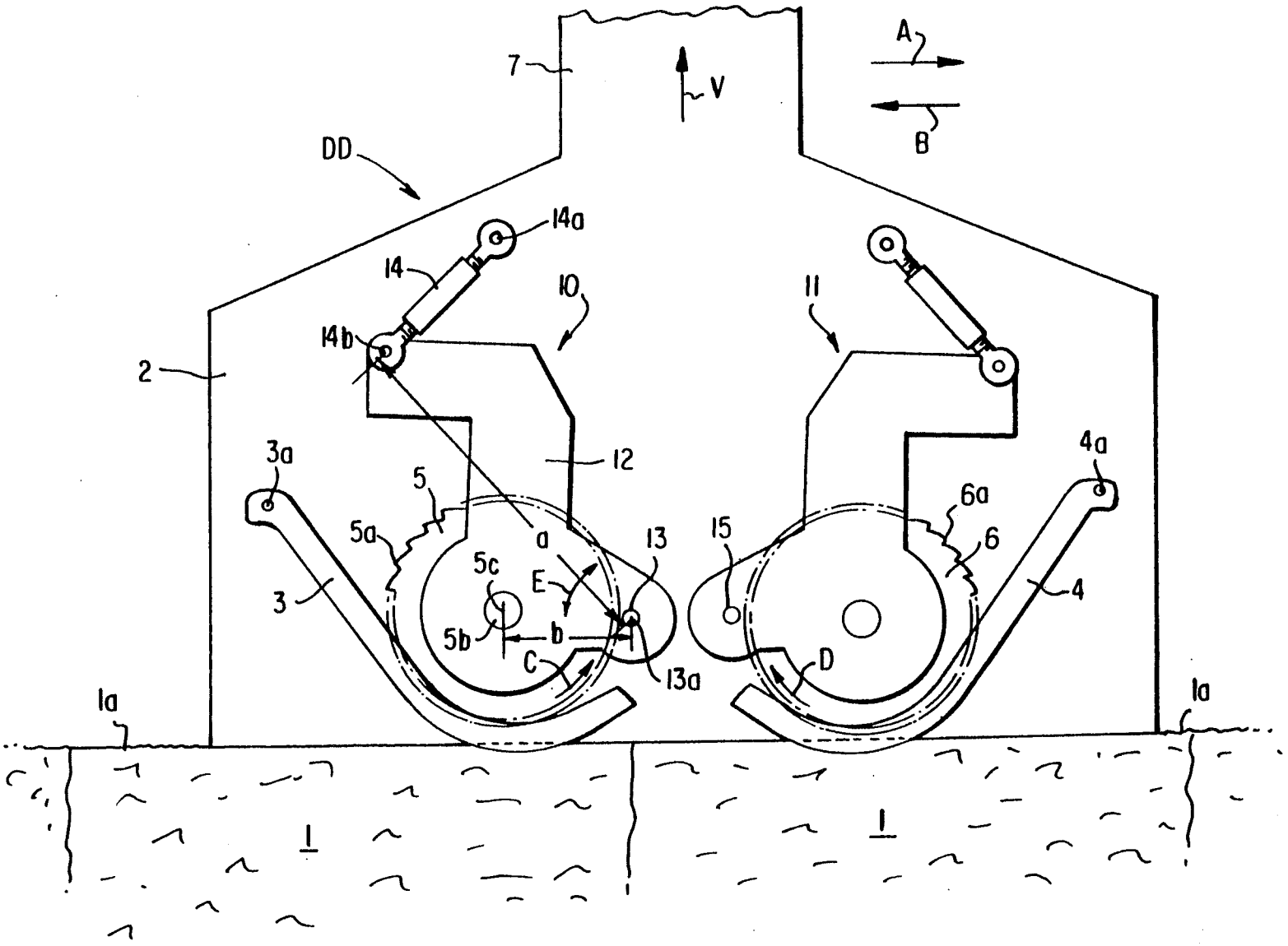
A
B
V
7
DD
2
1a
1a
1
4a
4
6a
6
11
D
15
13
13a
12
10
14a
14
14b
a
E
b
C
5c
5b
5
5a
3a
3

FIBER BALE OPENER HAVING SEPARATELY ADJUSTABLE OPENING ROLL PENETRATIONS

A CROSS REFERENCE TO RELATED APPLICATIONS

This application is a continuation-in-part of application Ser. No. 07/387,992 filed Aug. 1, 1989, now U.S. Pat. No. 5,090,091 issued Feb. 25, 1992.

This application also claims the priority of German Application Nos. P 38 26 201.0 filed Aug. 2, 1988 and P 39 13 929.8 filed Apr. 27, 1989, which are incorporated herein by reference.

BACKGROUND OF THE INVENTION

1. Field of the Invention

This invention relates to an opening device for detaching fiber tufts from compressed fiber bales such as cotton or cellulose fiber bales or the like. The opening device has rapidly rotating opening (detaching) rolls which have toothed discs or spikes that cooperate with a grate whose grate bars are situated between the detaching discs or spikes. The opening device travels along the top face of the stationary fiber bales and detaches fiber tufts therefrom.

2. Description of the Related Art

In a known opening device the parallel axes of the opening rolls are in a horizontal alignment with one another. During the forward and return pass the opening rolls penetrate the upper surface of the fiber bale to an equal depth during the detaching operation. The opening rolls rotate in opposite directions such that in the zone of the fiber bales the circumferential part of the opening rolls move towards one another. It is a disadvantage of these constructions that as the detaching rolls travel in a given direction during the detaching operation, the two opening rolls detach different quantities of fiber tufts from the fiber bales (one opening roll rotates in the direction of travel and the other rotates oppositely thereto).

In the parent application Ser. No. 07/387,992 as well as in U.S. Pat. No. 4,928,354 (issued May 29, 1991) a pivotal height adjustment of the two opening rolls is provided; the rolls, however, are pivoted in a vertical plane as a unit, that is, no individual pivotal adjustment is feasible.

United Kingdom Patent No. 946,333 discloses a fiber bale opening apparatus having a series of parallel-arranged opening rolls and further wherein the fiber bales are conveyed underneath the opening rolls. Each opening roll is individually vertically linearly adjustable. As viewed in the direction of relative displacement of the rolls with respect to the fiber bales, during operation each roll is at a higher level than the roll which trails it.

SUMMARY OF THE INVENTION

It is an object of the invention to provide an improved opening device of the above-outlined type which, by virtue of an individual pivotal adjustment of the detaching rolls, is capable of ensuring that the oppositely rotated detaching rolls simultaneously remove identical fiber tuft quantities from the fiber bales during opening passes in either direction of travel of the bale opener and which is of simplified construction and operates with reduced forces compared to linear adjusting mechanisms.

This object and others to become apparent as the specification progresses, are accomplished by the invention, according to which, briefly stated, the travelling fiber tuft detaching device for removing fiber tufts from top surfaces of stationarily supported fiber bales includes a housing; first and second toothed, parallel detaching rolls accommodated in the housing; first and second pivot frames carrying the first and second detaching rolls, respectively; a pivot shaft for pivotally securing the first and second pivot frames to the housing to provide for a pivotal motion of each pivot frame in substantially vertical plane relative to the housing; and first and second setting devices articulated to the first and second pivot frames, respectively, and to the housing for exerting separately settable adjusting forces to the first and second pivot frames, whereby a height level of the detaching rolls relative to one another is set for effecting penetration of the detaching rolls into a top bale surface to different depths thereof during the detaching operation.

The construction according to the invention is particularly advantageously adapted for a fiber tuft removing operation in which the leading opening roll — as viewed in the direction of travel of the bale opener — is at a lower level than the trailing opening roll. Such a relationship ensures a deeper penetration of the leading roll into the fiber material than the trailing roll, whereby the leading roll detaches a larger quantity of fiber tufts than if it were at the same level as the trailing roll. In view of the direction of rotation of the leading roll, the latter detaches less material than the trailing roll and thus a deeper positioning of the leading roll results in an equalization of the quantities detached by the leading opening roll on the one hand and the trailing opening roll on the other hand. By virtue of an individual adjustability of the two detaching rolls a full equalization of the detached fiber quantities may be achieved.

It is a further advantage of the invention that the lifting or suspension force needed for the setting device to hold the opening roll may be less than the weight of such opening roll in view of the force arm (torque) relationships between the weight of the opening roll and the suspension force of the setting device related to the pivotal axis of the pivot frame.

BRIEF DESCRIPTION OF THE DRAWING

The sole FIGURE is a schematic side elevational view of a preferred embodiment of the invention.

DESCRIPTION OF THE PREFERRED EMBODIMENT

Turning to the sole FIGURE, there is illustrated therein a preferred embodiment of the invention which may be incorporated in a travelling bale opener, such as a BLENDOMAT BDT model, manufactured by Trützschler GmbH, Mönchengladbach, Germany. The fiber bales 1 are freely supported on the ground and are arranged in a series along which the bale opener trolley travels back and forth on rails (neither shown). The bale opener has a vertically shiftable detaching device generally designated at DD, essentially comprising a detacher housing 2, two grates 3 and 4 (each formed of a series of grate bars) articulated to the housing 2 at 3*a* and 4*a*, respectively, two rapidly rotating detaching (opening) rolls 5 and 6 as well as a suction duct 7 for removing, by a vacuum stream V, the fiber tufts detached from the upper surface of the fiber bales. During the fiber tuft removing (detaching) operation, the detaching device DD travels either in the direction A (forward pass) or in the direction B (reverse or return pass). The grates 3 and 4 are so arranged that their grate bars extend into the clearances between the axially spaced teeth 5*a*, 6*a* of the disc series of rolls 5 and 6. The grates 3 and 4 engage the top face 1*a* of the fiber bales and thus constitute a hold-down device.

The direction of rotation of the detaching rolls 5 and 6, designated with arrows C and D, is oriented inwardly in the zone of the upper face 1*a* of the fiber bales 1. In operation, the detaching device DD, together with the detaching rolls 5 and 6 travels back and forth above the freely standing fiber bales 1 while the teeth 5*a*, 6*a* of the respective detaching rolls 5 and 6 extend through the grate gaps defined by the grate bars of the grates 4 and 5 and penetrates into the fiber bale surface. The fiber tufts torn out from the upper face 1*a* of the fiber bales 1 are thrown inwardly by the detaching rolls 5 and 6. The fiber tufts are immediately introduced into the vacuum stream V and conveyed thereby through the suction duct 7 and removed from the bale opener by the air stream in a known manner for further processing.

Each opening roll 5 and 6 has its own height-adjusting assembly generally designated at 10 and 11, respectively. The two height-adjusting assemblies 10 and 11 are of identical construction; in the description which follows, the height-adjusting assembly 10 will be explained in detail.

The opening roll 5 has a shaft 5*b* which is rotatably held in a pivot frame 12. The pivot frame 12 is secured to the housing 2 by a pivot shaft 13 for pivotal motion in a vertical plane as designated by the double-headed arrow E. A setting device 14 is, at one end, pivotally secured to the housing 2 by means of an articulation 14*a* and is, at its other end, pivotally secured to the frame 12 by means of an articulation 14*b*. The setting device 14 may be a turn buckle-type assembly or it may comprise a power cylinder to exert an adjusting force and a holding force on the frame 12 along a line connecting the pivots 14*a* and 14*b*. The force is applied as a torque to the axis 13*a* of the pivot shaft 13; such torque is composed by the product of the force exerted by the setting device 14 and the distance (arm) between the direction of the force exerted by the setting device 14 from the axis 13*a*. Such distance equals the distance a between the axis of the articulation 14*b* and the axis 13*a*, provided that the direction of the force exerted by the setting device 14 is perpendicular to the line connecting 13*a* with 14*b*. Thus, by applying a pulling force on the frame 12 by the setting device 14, the frame 12 and thus the opening roll 5 is pivoted clockwise about the axis 13*a* to thus raise the opening roll 5. Conversely, a release of the holding force by the setting device 14 will cause the frame 12 and thus the opening roll 5 to pivot, by its own weight, counterclockwise about the axis 13*a* resulting in a lowering of the opening roll 5. Thus, the force required of the setting device 14 to maintain the roll carrying frame 12 in balance may be less than the weight of the opening roll: such force/weight relationship is essentially determined by the b:a ratio, where b is the distance between the axis 5*c* of the shaft 5*b* and the axis 13*a* of the pivot shaft 13.

The identically constructed adjusting assembly 11 is mounted in a mirror image fashion relative to the adjusting assembly 10 such that the pivot shaft 13 of the adjusting assembly 10 and the pivot shaft 15 of the adjusting assembly 11 are in an adjoining, side-by-side relationship, that is, the two adjusting assemblies 10, 11 are arranged back-to-back. The individual pivotal suspension of the two detaching rolls 5, 6 ensures a sufficient free space therebetween for accommodating, for example, a toothed idling pressing roller (not shown) which extends parallel to the detaching rolls and which is supported by the housing 2. Such pressing roll penetrates with its teeth into the bale surface and assists the grates 3 and 4 in stabilizing the fiber bales 1.

During operation, when the bale opener performs its forward detaching pass while travelling in the direction A, the adjusting assemblies 10 and 11 are set in such a manner that the opening roll 6 is at a lower level than the opening roll 5. At the end of the forward detaching pass, while the directions of rotation C and D of the detaching rolls 5 and 6 remain the same, the adjusting assemblies 10 and/or 11 are switched such that the opening roll 5 will be at a lower level than the opening roll 6 to ensure the deeper penetration of the opening roll 5 as the bale opener travels in the direction B during its reverse detaching pass. Such a switching operation of the two adjusting assemblies 10, 11 may be effected from a central control of the bale opener. The individual, separate height-adjustability of the two detaching rolls 5 and 6 makes it possible to set the height of the two rolls 5 and 6 relative to one another in such a manner that the distance of one roll from a horizontal reference level which connects the axes of the two pivot shafts 13 and 15 is other than the distance of the other roll from such horizontal reference level. This, in turn, allows such a relative height position between the two rolls 5 and 6 that a full equalization of the fiber tuft quantities removed simultaneously by the two rolls 5, 6 is ensured.

It will be understood that the above description of the present invention is susceptible to various modifications, changes and adaptations, and the same are intended to be comprehended within the meaning and range of equivalents of the appended claims.

What is claimed is:

1. A travelling fiber tuft detaching device for removing fiber tufts from top surfaces of stationarily supported fiber bales, comprising (a) a housing;

(b) first and second toothed detaching rolls accommodated in the housing; the detaching rolls being rotatable about substantially horizontal roll axes spaced from one another in a travelling direction of the detaching device; said roll axes being oriented transversely to said travelling direction;

(c) first and second pivot frames carrying said first and second detaching rolls, respectively;

(d) pivot shaft means for pivotally securing said first and second pivot frames to said housing to provide for a pivotal motion of each said pivot frame in a substantially vertical plane relative to the housing; and (e) first and second setting devices articulated to said first and second pivot frames, respectively, and to said housing for exerting separately settable adjusting forces to said first and second pivot frames, whereby a height level of said detaching rolls relative to one another is set for effecting penetration of said detaching rolls into a top bale surface to different depths thereof during the detaching operation.

2. A travelling fiber tuft detaching device as defined in claim 1, wherein a distance between a location of articulation of the first setting device to the first frame and an axis of said pivot shaft means for said first pivot frame is greater than a distance between the axis of said first detaching roll and said axis of said pivot shaft means for said first pivot frame.

3. A travelling fiber tuft detaching device as defined in claim 1, wherein said pivot shaft means comprises a first pivot shaft supporting said first pivot frame and a second pivot shaft spaced from said first pivot shaft and supporting said second pivot frame.

4. A travelling fiber tuft detaching device as defined in claim 1, wherein said pivot shaft means is located between the axes of said first and second detaching rolls and said first and second pivot frames ar oriented back-to-back.

* * * * *